US006071158A

United States Patent [19]

Mashiko

[11] Patent Number: 6,071,158

[45] Date of Patent: Jun. 6, 2000

[54] ENGINE CYLINDER HEAD COOLANT JACKET

[75] Inventor: Tetsuya Mashiko, Shizuoka, Japan

[73] Assignee: Yamaha Hatsudoki Kabushiki Kaisha, Japan

[21] Appl. No.: 09/099,718

[22] Filed: Jun. 18, 1998

[30] Foreign Application Priority Data

Jun. 18, 1997 [JP] Japan ..... 9-161094

[51] Int. Cl.[7] ..... B63H 21/10

[52] U.S. Cl. ..... 440/88

[58] Field of Search ..... 440/88, 89, 113, 440/900; 123/41.08

[56] References Cited

U.S. PATENT DOCUMENTS

| | | | |
|---|---|---|---|
| Re. 34,226 | 4/1993 | Morishita . | |
| 3,667,431 | 6/1972 | Kueny et al. | 123/41.08 |
| 4,545,332 | 10/1985 | Suzuki et al. . | |
| 4,588,385 | 5/1986 | Suzuki et al. . | |
| 4,972,807 | 11/1990 | Morishita . | |
| 5,036,804 | 8/1991 | Shibata . | |
| 5,081,960 | 1/1992 | Shimamoto . | |
| 5,094,193 | 3/1992 | Yoshikawa . | |
| 5,095,704 | 3/1992 | Nagura et al. . | |
| 5,113,807 | 5/1992 | Kobayashi . | |
| 5,222,464 | 6/1993 | Oyaizu . | |
| 5,379,729 | 1/1995 | Yonezwa et al. . | |
| 5,385,125 | 1/1995 | Oyaizu et al. . | |
| 5,575,245 | 11/1996 | Watanabe . | |
| 5,715,777 | 2/1998 | Wada | 440/88 |
| B1 4,588,385 | 7/1993 | Suzuki et al. . | |

*Primary Examiner*—Stephen Avila
*Attorney, Agent, or Firm*—Knobbe, Martens, Olson & Bear LLP

[57] ABSTRACT

A multiple cylinder engine for a small watercraft is provided with a separately structured cylinder head and cylinder head cover which cooperate when fastened together to define a cylinder head water jacket with chambers for cooling each cylinder in the engine. A longitudinally oriented coolant passage runs past and communicates with each water jacket chamber to facilitate flow of cooling water out of each chamber. In an embodiment in which the cylinders are inclined, the coolant passage is positioned in a higher location than the water jacket chambers.

40 Claims, 4 Drawing Sheets

ENGINE CYLINDER HEAD COOLANT JACKET

BACKGROUND OF THE INVENTION

1. Field of the Invention

The present invention relates to a device for reducing the temperature in the cylinder head of a multiple cylinder marine engine.

2. Description of Related Art

Personal watercrafts have become popular in recent years. This type of watercraft is quite sporting in nature and is designed to carry a rider and possibly one or two passengers. A relatively small hull of the personal watercraft commonly defines a rider's area above an engine compartment.

An internal combustion engine frequently powers a jet propulsion unit which propels the watercraft. The engine lies within the engine compartment in front of a tunnel formed on the underside of the watercraft hull. The jet propulsion unit is located within the tunnel and is driven by a drive shaft. The drive shaft commonly extends between the engine and the jet propulsion device, through a wall of the hull that forms a front gullet portion of the tunnel.

Personal watercrafts often employ an in-line, multi-cylinder, crankcase compression, two-cycle engine, usually including two or three cylinders. The engine conventionally lies within the engine compartment with the in-line cylinders aligned along a longitudinal axis of the watercraft's hull (in the bow-stern direction).

An exhaust manifold typically couples the exhaust ports of the engine cylinders to an exhaust system. The exhaust system discharges exhaust byproducts from the watercraft. The exhaust system commonly includes a water jacket which cools at least a portion of the exhaust system. At least a portion of the cooling water usually is introduced into the exhaust stream after an expansion chamber of the exhaust system to further silence exhaust noise and for discharge from the watercraft.

The engine usually includes a cylinder head which is mounted on top of a cylinder block and defines in part the combustion chamber of the engine. Water jackets are normally formed within the cylinder head and cylinder block to cool the engine heated by the combustion. Conventionally, the cylinder head has been manufactured by casting, thus necessitating complicated manufacturing processes to cast the passages that make up the water jacket within the cylinder head. Such complicated manufacturing processes result in increased manufacturing costs.

SUMMARY OF THE INVENTION

A need therefore exists for a cylinder head water jacket which effectively cools the cylinders but avoids the complexities and costs of conventional casting of the water jacket within the cylinder head.

An aspect of the present invention involves a multi-cylinder engine for a small watercraft. The engine includes a cylinder block assembly that defines a plurality of cylinders and a cylinder head coupled to the cylinder block assembly. The cylinder block assembly and the cylinder head together form, at least in part, a plurality of combustion chambers of the engine. A cylinder head cover is attached to the cylinder head opposite of the cylinders. The cylinder head and the cylinder head cover together define at least one coolant jacket that at least partially surrounds one of the combustion chambers.

Another aspect of the present invention involves a watercraft comprising an engine that includes at least one combustion chamber and an output shaft. A propulsion device is driven by the output shaft. A cooling system is provided for cooling the engine. The cooling system includes at least one coolant jacket that at least partially juxtaposes at least one of the combustion chambers of the engine. The coolant jacket is defined at least in part by a cylinder head and a cylinder head cover of the engine. The cylinder head and the cylinder head cover are formed separately from each other.

In accordance with an additional aspect of the present invention, a multi-cylinder engine for a small watercraft is provided. The engine comprises a plurality of combustion chambers and a plurality of coolant jackets. Each coolant jacket juxtaposes at least a portion of one of the combustion chambers. A coolant passage communicates with each of the coolant jackets. The coolant passage is arranged on the engine so as to be generally higher than each of the coolant jackets.

These and other features of the present invention will become more fully apparent from the following description and claims.

BRIEF DESCRIPTION OF THE DRAWINGS

The above-mentioned and other features of the invention will now be described with reference to the drawings of a preferred embodiment of the present cylinder head assembly construction. The illustrated embodiment is intended to illustrate, and not to limit the invention. The drawings contain the following figures.

DETAILED DESCRIPTION OF THE PREFERRED EMBODIMENT OF THE INVENTION

Figure 1:
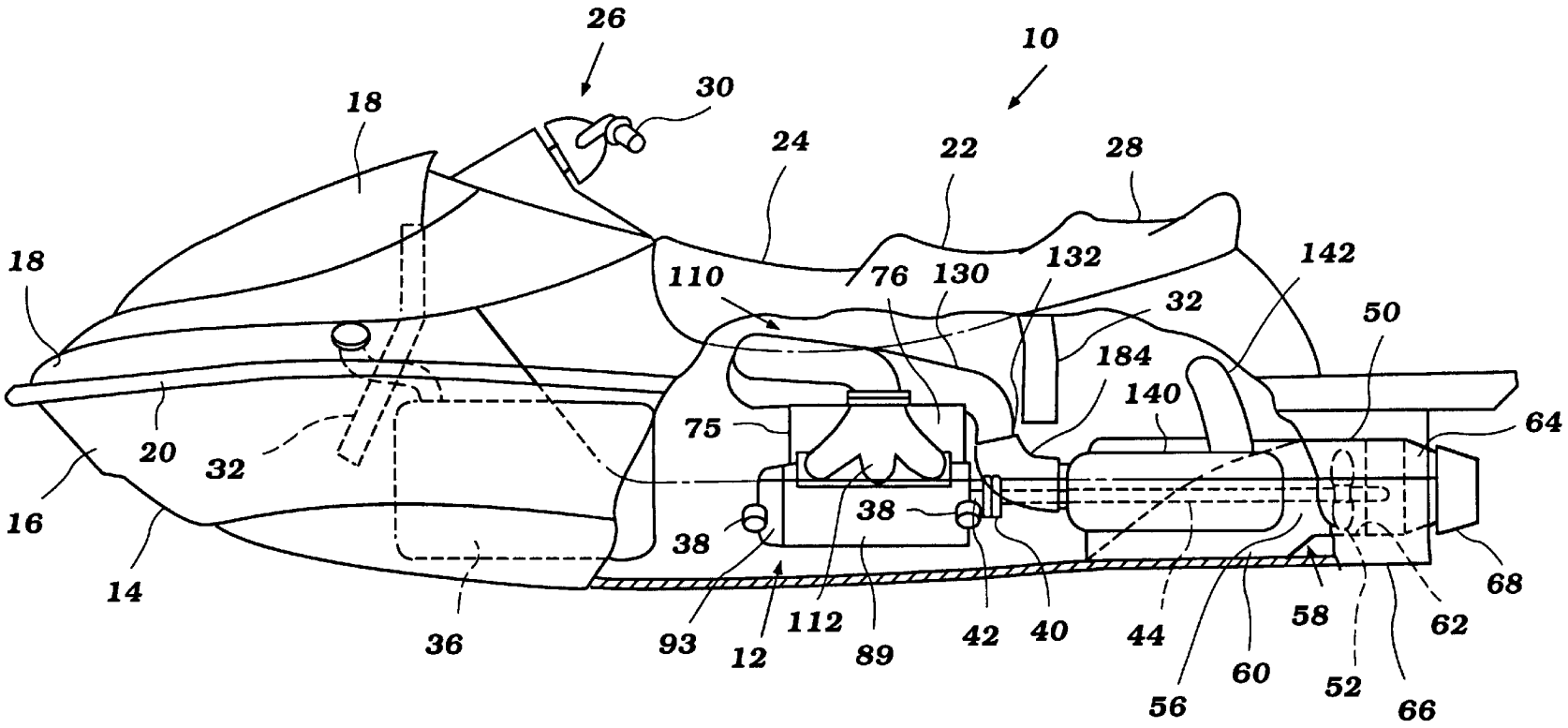
FIG. 1 is a side elevational view of the personal watercraft of the present invention partially cut away to show the engine and exhaust systems in accordance with a preferred embodiment.

FIG. 1 illustrates a personal watercraft 10 which includes a marine engine 12 configured in accordance with a preferred embodiment of the present invention. Although the present engine 12 is illustrated in connection with a personal watercraft, the engine 12 can be used with other types of watercraft as well, such as, for example, but without limitation, small jet boats and the like.

Before describing the engine 12, an exemplary personal watercraft 10 will first be described in general details to assist the reader's understanding of the environment of use and the operation of the engine 12. The watercraft 10 includes a hull 14 formed by a lower hull section 16 and an upper deck section 18. The hull sections 16, 18 are formed from a suitable material such as, for example, a molded fiberglass reinforced resin. The lower hull section 16 and the upper deck section 18 are fixed to each other around the peripheral edge 20 in any suitable manner.

A passenger seat 22 is provided proximate to the stern of the hull 14. The passenger seat 22 is mounted longitudinally along the center of the watercraft 10. In the illustrated embodiment, the seat 22 has a longitudinally extended straddle-type shape which may be straddled by an operator and by at least one or two passengers. A forward end 24 of the seat 22 lies proximate to the controls 26 of the watercraft 10 which generally lie at about the longitudinal center of the watercraft 10. This position of the operator on the watercraft 10 gives the watercraft fore and aft balance when the operator rides alone. A rear portion 28 of the seat 22 is configured to allow one or two passengers to be comfortably seated behind the operator of the watercraft 10. The seat 22 desirably includes a removable seat cushion to increase the comfort of the operator and the passengers. An access opening is formed beneath the seat to allow access to an engine compartment formed within the hull 14.

The upper deck section 18 of the hull 14 advantageously includes foot areas. The foot areas extend generally longitudinally and parallel to the sides of the elongated seat 22 so that the operator and any passengers sitting on the seat 22 can place their feet in the foot areas. A non-slip surface (not shown) is located in the foot areas to provide increased grip and traction for the operator and the passengers.

The engine 12 is mounted primarily beneath the forward portion of the seat 22 in the engine compartment. Vibration-absorbing engine mounts 38 secure the engine 12 to the hull lower portion 16 in a known manner. The engine 12 is mounted in approximately a central position in the watercraft 10. A fuel tank 36 is located forward of the engine 12.

As seen in FIG. 1, a coupling 40 interconnects an engine output shaft 42 to an impeller shaft 44. If the engine output shaft 42 is vertically disposed, the impeller shaft 44 will be driven through a bevel gear transmission or a similar transmission. The impeller shaft 44 extends rearwardly to a jet propulsion unit 50 and drives an impeller 52 of the jet propulsion unit 50.

The jet propulsion unit 50 is positioned in a tunnel 56 in the rear center of the lower hull section 16. The propulsion unit 50 includes a gullet 58 having an inlet opening 60 formed on the bottom side of the lower hull section 16. The gullet 58 extends from the inlet opening 60 to a pressurization chamber 62. The pressurization chamber 62 in turn communicates with a nozzle section 64 of the propulsion unit 50. A ride plate 66 covers a portion of the tunnel 56 behind the gullet inlet 60 to enclose the pump chamber 62 and the nozzle 64 within the tunnel 56. In this manner, the lower opening of the tunnel 56 is closed by the front edge of the pump gullet 58 and the ride plate 66.

The rotating impeller 52, which the impeller shaft 44 drives, pressurizes the water within the chamber 62 and forces the pressurized water through the nozzle section 64 of the propulsion unit 50. A steering nozzle 68 directs the exit direction of the water stream exiting the jet propulsion unit 50. The steering nozzle 68 is pivotally supported at the rear of the jet propulsion unit 50 to change the thrust angle on the watercraft 10 for steering purposes as is known in the art.

The steering nozzle 68 is connected to a steering handle 30. The steering handle 30 forms part of the operator controls 26 which are mounted in front of the operator seat 22 as noted above. The steering handle 30 also can include a throttle control for controlling the speed of the engine 12.

The personal watercraft 10 so far described is conventional and represents only an exemplary watercraft on which the present engine 12 with improved cylinder head construction can be employed. A further description of the personal watercraft 10 therefore is not believed necessary for an understanding and an appreciation of the present invention. The details of the engine 12, including its exhaust system 110 and cooling system, will now be described in detail.

With reference to FIGS. 1 through 4, the engine 12 desirably is a multi-cylinder internal combustion engine. In the illustrated embodiment, the engine 12 includes three in-line cylinders and operates on a two-stroke, crankcase compression principle. The engine 12 is positioned such that the row of cylinders 70 lies parallel to a longitudinal axis of the watercraft 10, running from bow to stern. This engine type, however, is merely exemplary. Those skilled in the art will readily appreciate that the present engine principles can be used with other engine types having other number of cylinders and other cylinder arrangements.

The engine 12 includes a cylinder head 74 mounted to a cylinder block 72. In the illustrated embodiment, the cylinder block assembly 72 includes a plurality of parallel cylinder bores 70. The cylinder bores 70 are inclined relative to a vertical axis as best seen in FIG. 2.

Figure 2:
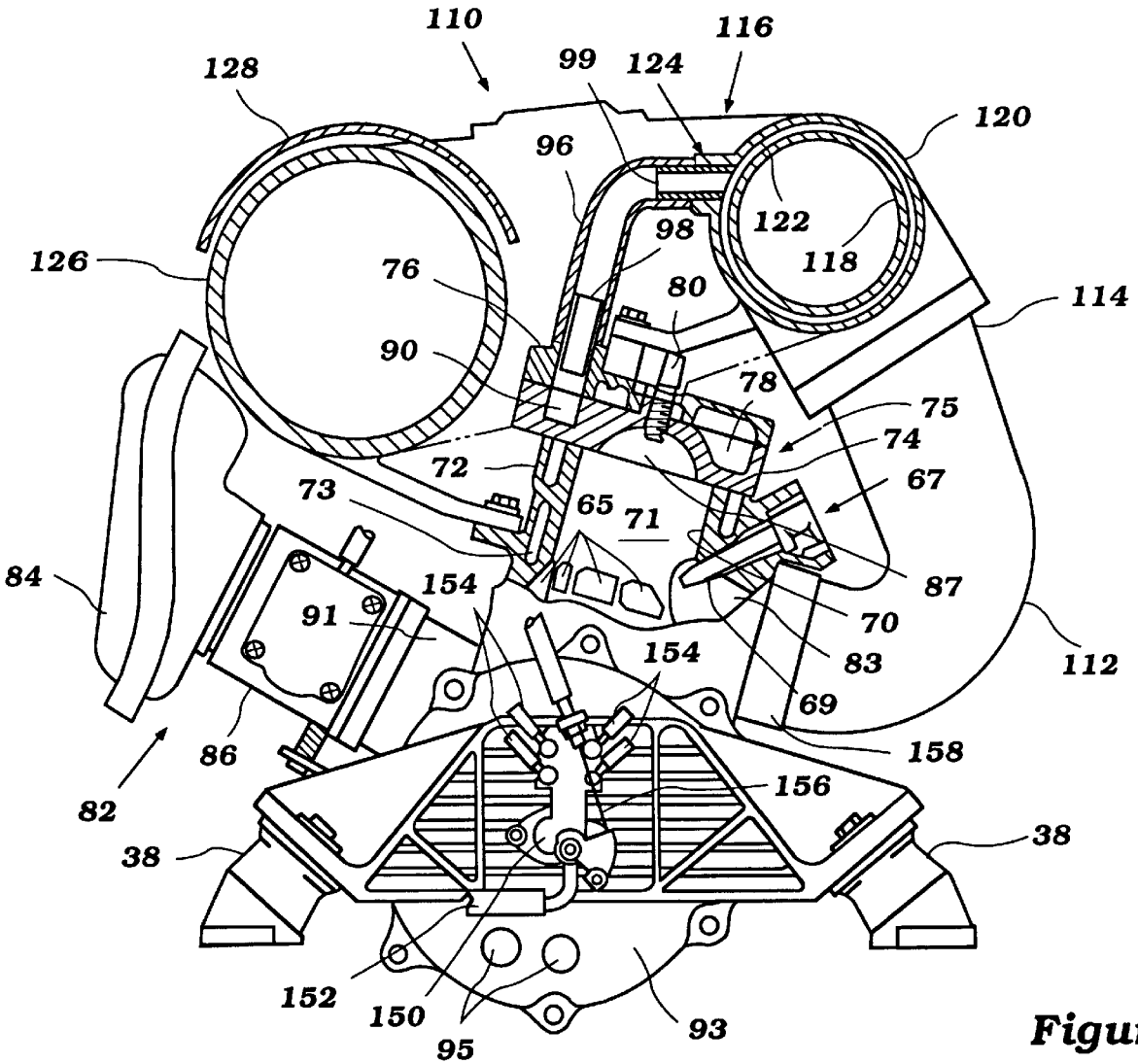
FIG. 2 is a sectional front elevational view of the engine of the watercraft of FIG. 1, illustrating portions of the cylinder head assembly and exhaust systems in section.

As understood from FIG. 2, each cylinder 70 includes a plurality of scavenge passages 65 formed in the cylinder block 72. In the illustrated embodiment, each cylinder 70 includes a main scavenge passage and a plurality of side scavenge passages circumferentially disposed about the cylinder bore 70. The scavenge passages terminate in respective scavenge ports formed in the cylinder 70.

Within the cylinder block 72, an exhaust passage 83 is also formed which communicates with each cylinder 70. Each exhaust passage 83 extends from an exhaust port formed in the side of the cylinder wall to an exhaust discharge port located on the side of the engine block 72. The exhaust port desirably 83 lies diametrically opposite the main scavenge port and between the side scavenge ports. The configuration of the ports desirably is designed to provide a Schnurle-type scavenging in the cylinder 70.

As also seen in FIG. 2, the engine 12 also desirably includes an exhaust control device 67. The control device 67 controls the flow of exhaust gases through the exhaust passage 83 from the cylinder 70 depending upon the speed of the engine 12. The exhaust control device 67 comprises a sliding-knife type or gate-type valve 69 and an actuator member or transmission (not shown) for moving the valve 69. The valve and transmission desirably are configured in accordance with allowed U.S. patent application Ser. No. 08/847,830, filed Apr. 17, 1997, in the name of Shigeharu Mineo, entitled "WATERCRAFT EXHAUST CONTROL," and assigned to the assignee hereof, which is hereby incorporated by reference.

Figure 4:
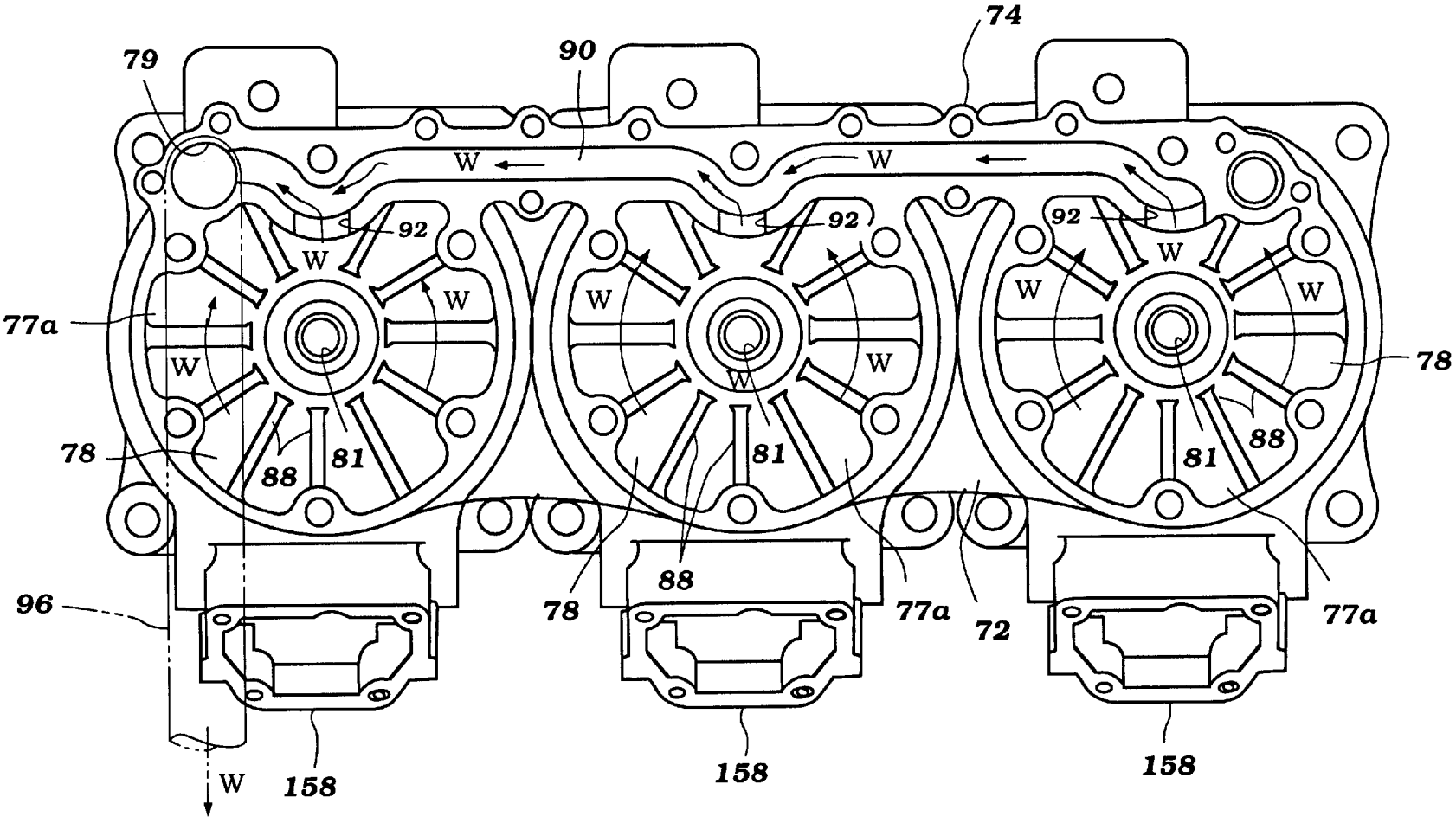
FIG. 4 is a top plan view of a cylinder head of the present cylinder head assembly, shown with a cylinder head cover removed.

As seen in FIG. 2, the cylinder head assembly is formed by the cylinder head 74 and the cylinder head cover 76. These components desirably are separately formed and are attached together when assembled. The cylinder head assembly is affixed to an upper end of the cylinder block in a known manner. As seen in FIG. 4, the cylinder head 74 includes a plurality of mounting holes 85 which receive fasteners to secure the cylinder head 74 to the cylinder block assembly 72 in a known manner.

The cylinder head 74 includes a plurality of recesses 87. One of the recesses 87 cooperates with each cylinder bore 70 to close an end of the cylinder 70. The cylinder head assembly and the cylinder block assembly 72 also define a plurality of water jacket passages 73 which encircle at least a portion of the upper ends of the cylinders 70.

A piston (not shown) reciprocates within each cylinder bore 70. The head of the piston, the cylinder bore 70 and the recess 87 in the cylinder head 74 together define a variable volume chamber which, at minimal volume, defines a combustion chamber for each cylinder 70.

The pistons are rotatably journaled about the small ends of a connecting rod by means of piston pins. The big ends of the connecting rods in turn are journaled about throws of a crankshaft 42 of the engine 12. In the illustrated embodiment, the crankshaft 42 extends beyond a rear end of the engine 12 to also function as an output shaft of the engine 12, as noted above.

A crankcase member 89 is attached to a lower end of the cylinder block assembly 72 and forms a plurality of crankcase chambers at the ends of the cylinder bores 70. The crankshaft 42 is rotatably journaled within the crankcase chambers. As has been noted, the engine 12 operates on a two-cycle crankcase compression principle. As is typical with such engines, the crankcase chambers associated with each of the cylinder bores 70 are sealed relative to each other. For this purpose, the crankshaft 42 includes sealing disks (not shown). These disks are disposed on the throws of the crankshaft 42 and separate the big ends of adjacent connecting rods.

Figure 3:
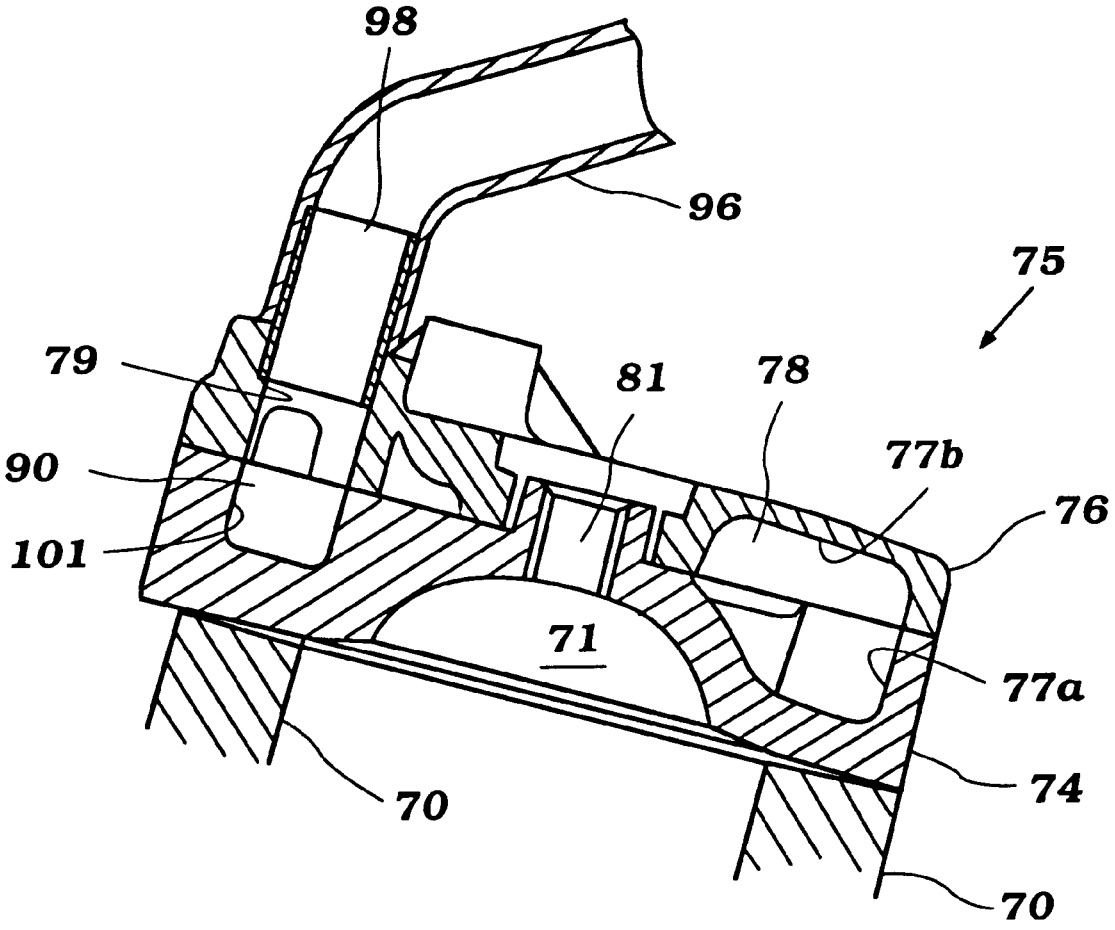
FIG. 3 is an enlarged front sectional view of the cylinder head assembly of FIG. 2.

As seen in FIGS. 2 and 3, a spark plug 80 is mounted atop each of the recesses 87 in the cylinder head 74 and has its gap extending into the corresponding combustion chamber 71. The spark plugs 80 are fired by an ignition control circuit (not shown) that is controlled by the ECU.

A fuel/air charge is delivered to the crankcase chambers by an induction system 82. In the illustrated embodiment, the induction system 82 is located on a side of the engine 12. An air intake silencer 84 is also located on that side of the engine 12.

The air intake 84 communicates with and supplies air to a plurality of charge formers 86. The engine 12 desirably includes a number of charge formers 86 equal to the number of cylinders 70 of the engine 12. In the illustrated embodiment, the charge formers 86 are floatless-type carburetors; however, it is understood that other types of charge formers, such as, for example, fuel injectors, also can be used with the engine 12. A fuel supply system delivers a continuous flow of fuel to the charge formers 86. The fuel desirably is recirculated between a fuel tank (e.g., the fuel storage tank 36) and the charge formers 86.

The fuel/air charge formed within the charge formers 86 is delivered to the corresponding crankcase chamber through an intake passage of an intake manifold 91. In the illustrated embodiment, the intake manifold 91 lies below the carburetors 86. Each intake passage of the intake manifold 91 communicates with an outlet of one of the carburetors 86.

Upward motion of the piston in the corresponding cylinder draws atmospheric air and fuel from the respective carburetors 86 through the induction passage or intake passage into the crankcase chamber, past a corresponding reed valve (not shown). The reed valve is open at this point, because of the pressure of the induction passage is greater than the pressure in the crankcase chamber.

Sometime after the piston passes top dead center (TDC), the pressure in the crankcase chamber exceeds the induction passage pressure, and the reed valve closes. The fuel/air mixture in the crankcase chambers is then compressed by the piston during its downstroke until the outlet port of the scavenge passage 65 is exposed to the combustion chamber 71. At this point, the compressed air/fuel mixture enters the combustion chamber through the scavenge passages 65 and is further compressed by the ensuing compression stroke of the piston.

At some time before the piston passes top dead center (TDC), the spark plug 80 gets fired by the ECU and the fuel/air mixture ignites, bums, and expands. This forces the piston downward, thus driving the crankshaft. Continuing downward motion of the piston exposes the exhaust passage to the combustion chamber 71, and thus permits the combustion gases to expel from the combustion chamber 71 through the exhaust passage 83.

A conventional magneto-flywheel assembly 93 desirably triggers the ignition. The magneto-flywheel assembly 93 is connected to the crankshaft 42 on the front side of the engine 12 in the illustrated embodiment. A signal pulsar coil, which is used with the magneto-flywheel assembly 93, produces a signal indicative of the particular crankshaft angle. The signal pulse desirable is received and processed by the ECU to determine the specific crankshaft angle at a given time. The ECU then uses this information to control ignition timing (and injection timing and duration in some applications). The flywheel-magneto assembly 93 is contained within a housing on the front side of the engine 12. The housing includes a plurality of openings 95. Wire harnesses pass through these openings 95 to connect to the flywheel-magneto assembly 93.

The engine 12 also includes an oil supply system. In the illustrated embodiment, the oil supply system provides oil to the induction system, desirably at a point above a throttle valve of the carburetor assembly 86. The oil, however, can be introduced at other locations, such as, for example, to the intake passage or directly into the crankshaft chamber, as known in the art.

In the illustrated embodiment, the oil delivery system includes a mechanical pump 150 which draws oil from an oil supply tank through an oil delivery line 152 and delivers the oil to the engine 12 via a plurality of delivery conduits 154. An actuator cable 156 attaches to the pump 150 so as to actuate the pump 150 upon movement of the throttle control on the control handle which also operates the throttle valves of the charge formers 86.

An exhaust manifold 112 is attached to the side of the engine 12 opposite the induction system 82 and communicates with the exhaust discharge ports associated with each cylinder 70. The cylinder block assembly 72 includes a plurality of bosses 158 for this purpose (FIG. 4). The exhaust manifold 112 delivers exhaust byproducts to an exhaust system 110 for discharge, as described below.

As best understood with reference to FIGS. 1 and 2, the exhaust system 110 is provided to discharge exhaust byproducts from the engine to the atmosphere and/or to the body of water in which the watercraft 10 is operated. The exhaust system includes a C-shaped header pipe section 116. This header pipe 116 includes an inner tube 118 that communicates directly with the discharge end 114 of the exhaust manifold 112. An outer tube 120 surrounds the inner tube 118 to form a coolant jacket 122 between the inner and outer tubes 118, 120.

The outlet end of the inner header tube 118 communicates with an expansion chamber 126. A shield 128 desirably covers the expansion chamber 126. Although not shown, the expansion chamber 126 may also include a water jacket that receives at least a portion of water from the header pipe water jacket.

The outlet end of the expansion chamber 126 comprises a reducer pipe 130 which tapers in diameter toward its outlet 132.

The lower section of the reducer pipe 130 includes a downwardly turned portion that terminates at the discharge end 132. Water desirably is introduced into the exhaust stream at the downstream end of the reducer pipe 130. For this purpose, water can either be sprayed into the exhaust stream or a water jacket within the reducer pipe 130 can terminate to merge coolant water with the exhaust gas flow through the exhaust passage at the discharge end 132.

A flexible pipe 134 is connected to the discharge end 132 of the reducer pipe 130 and extends rearwardly along one side of the watercraft hull tunnel 56. The flexible conduit 134 connects to an inlet section of a water trap device 140. The water trap device 140 also lies within the watercraft hull 16 on the same side of the tunnel 56.

The water trap device 140 has a sufficient volume to retain water and to preclude the back flow of water to the expansion chamber 126 and the engine 12. Internal baffles within the water trap device 140 help control water flow through the exhaust system 110.

An exhaust pipe 142 extends from an outlet section of the water trap device 140. The pipe 142 wraps over the top of the tunnel 56 to discharge exhaust into the tunnel 56 at an area that is close to or actually below the water level with the watercraft 10 floating at rest on the body of water.

An engine and exhaust cooling system is provided for cooling the engine 12 and the exhaust system 110. The cooling system is formed in part by the coolant passages and jackets described above in connection with the exhaust system 110. Further coolant passages and jackets are provided in the cylinder block 72.

The cylinder head assembly also includes at least one coolant jacket 78 that forms a portion of the cooling system. The coolant jacket 78 desirably is formed between the cylinder head 74 and the cylinder head cover 76 in order to reduce fabrication costs and to simplify manufacture of the engine 12. In the illustrated embodiment, the cylinder head assembly includes a plurality of coolant jackets 78, which desirably equal the number of cylinders of the engine 12, as explained below.

As best understood from FIGS. 3 and 4, the cylinder head 74 defines a plurality of concave chambers 77. These chambers 77*a* correspond to the number of recesses formed on the lower side of the cylinder head and lie next to (i.e., juxtapose) at least a portion of the corresponding recess. That is, at least a portion of each chamber 77*a* lies directly above at least a portion of the corresponding recess. In the illustrated embodiment, each chamber 77*a* surrounds the corresponding recess so as to surround the respective combustion chamber when the engine is assembled. Each chamber 77*a* desirably has a somewhat circular shape, as seen in FIG. 4.

A spark plug hole 81 is formed at the center of each recess in the cylinder head. These holes, which are threaded, receive the spark plug heads and electrodes that extends into the combustion chambers when assembled. In the illustrated embodiment, the corresponding concave chamber 77*a* on the upper side of the cylinder head 74 is generally symmetrically arranged relative to the spark plug hole 81. Reinforcing ribs 88 radiate outward from the hole in each chamber 77*a* to strengthen the cylinder head at this location; the material of the cylinder head is thinned because the recess is formed on one side and the corresponding chamber 77 is formed on the other side. The reinforcing ribs add greater strength and rigidity to the resulting upper wall of the corresponding combustion chamber.

The cylinder head cover 76 similarly defines concave chambers 77*b* that correspond to the chambers 77*a* of the cylinder head. When the cylinder head cover is placed on and secured to the cylinder head, the corresponding concave chambers 77*a*, 77*b* of the cylinder head 74 and cover 76 form the respective coolant jacket 78. Alternatively, the cylinder head cover 76 may not have concave chambers 77 formed therein, but the cylinder head 74 will have such chambers 77*a*. In such a case, the water jacket 78 would still be formed when the head cover 76 is fastened onto the cylinder head 74.

Each coolant jacket 78 desirably communicates with a coolant jacket or passage formed in the cylinder head 74 or cylinder block 72 to provide for a flow of coolant (e.g., water) through the coolant jackets 78 in the cylinder head assembly. A gasket or like seal is placed between the cylinder head 74 and the cover 76 to seal each of the coolant jackets 78 when assembled.

The cylinder block 72 also includes a water jacket 73 formed within its wall. The cylinder block water jacket 73 communicates with the cylinder head water jacket 78 to provide the flow of cooling water W to the water jacket chambers 77*a*, 77*b*. Alternatively, the cylinder head water jacket 78 could be supplied with fresh cooling water by a supply hose and input port (not shown).

Each cylinder head water jacket 78 communicates with a coolant passage 90 through a connection groove 92 formed at least in the cylinder head 76 or in the cylinder head cover 76. The coolant passage 90 extends longitudinally past each concave chamber 77*a*, 77*b* at terminates at an end 101. The longitudinal direction of the coolant passage 90 extends from stern to bow in the same direction as the crankshaft 42.

As best seen in FIG. 2, the coolant passage 90 is positioned at the uppermost corner of the inclined row of cylinders 70. Such placement locates the passage 90 higher than the water jackets 78 in the cylinder head assembly. Consequently, any air that may enter the water jacket 78 will thus flow upward and out of the concave chambers 77*a*, 77*b* into the coolant passage 90.

The delivery pipe 96 connects to the head cover 76 by way of a water pipe fitting 98 which extends through a hole 79 in the head cover 76 and communicates with the end 101 of the coolant passage 90. The other end of the delivery pipe 96 is connected to a fitting 99 of an inlet port 124 to the water jacket 122 of the header pipe 116.

In the illustrated embodiment, the jet pump unit 50 supplies water to the cooling system. A delivery conduit (not shown) delivers cooling water to the exhaust manifold 112. The water then flows through the coolant jackets of the cylinder block 72 and into the coolant jackets 78 in the cylinder head assembly. The water exits the cylinder head water jackets 78, flows through the coolant passage 90 and into the delivery pipe 96. The cooling water is then directed into the coolant jacket 122 of the header pipe 116 to cool this section of the exhaust system 110.

The cooling water, or at least a portion thereof, thence can be introduced into the exhaust system 110 downstream of the expansion chamber 126, be directed through a coolant jacket surrounding the expansion chamber (per the above-described variation not illustrated), or be discharged to the body of water in which the watercraft is operated. The cooling system can also introduce cooling water from other point (e.g., directly from the jet pump) into the exhaust system at a point downstream from the exhaust manifold to cool and silence the exhaust gases.

The present construction of the cylinder head and cover thus form the cooling jackets in the assembly without a complicated molding process. These separately formed components are easily assembled and sealed together to form the cooling jackets. In this manner, engine manufacturing costs are reduced.

Although this invention has been described in terms of a certain embodiment, other embodiments apparent to those of ordinary skill in the art also are within the scope of this invention. Accordingly, the scope of the invention is intended to be defined only by the claims that follow.

What is claimed is:

1. A multiple cylinder engine for a small watercraft comprising a cylinder block assembly defining a plurality of cylinders, at least two of the cylinders being adjacent to each other and having longitudinal center lines that lie in a cylinder plane, a cylinder head coupled to the cylinder block assembly to form at least in part a plurality of combustion chambers within the engine, and a cylinder head cover attached to the cylinder head opposite of the cylinders, the cylinder head and the cylinder head cover together defining at least one coolant jacket that at least partially surrounds at least one of the combustion chambers, the coolant jacket adapted so that coolant generally flows therethrough in a direction substantially transverse to the cylinder plane.

2. An engine as in claim 1, wherein the cylinder head and the cylinder head cover define a plurality of coolant jackets, and each coolant jacket surrounds at least a portion of a corresponding one of the combustion chambers.

3. An engine as in claim 2, wherein a coolant passage, which is formed at least in part by at least one of the cylinder head and the cylinder head cover, communicates with each of the coolant jackets.

4. An engine as in claim 3, wherein the coolant passage is formed by the cylinder head and the cylinder head cover.

5. An engine as in claim 3, wherein the engine includes an output shaft, and the coolant passage extends in a direction generally parallel to a rotational axis of the output shaft.

6. An engine as in claim 3, wherein the cylinders of the engine are inclined with each cylinder lying about a corresponding incline axis, and the coolant passage is arranged above the incline axes.

7. An engine as in claim 2, wherein the cylinder head has a plurality of concave chambers that are closed to form the coolant jackets when the cylinder head cover is attached to the cylinder head.

8. An engine as in claim 7, wherein the cylinder head cover includes a plurality of concave chambers that correspond and cooperate with the chambers in the cylinder head to form the coolant jackets when the cylinder head cover and cylinder head are attached together.

9. An engine as in claim 7, wherein the cylinder head additionally includes a plurality of reinforcing ribs arranged within the concave chambers.

10. A watercraft comprising an engine including at least one combustion chamber and an output shaft, a propulsion device driven by the output shaft, and a cooling system for the engine, the cooling system including at least one coolant jacket that at least partially juxtaposes the at least one combustion chamber, and a coolant passage communicating with the coolant jacket and formed generally above the coolant jacket, the coolant jacket and the coolant passage being defined at least in part by a cylinder head and a cylinder head cover of the engine that are formed separately from each other.

11. A watercraft as in claim 10, wherein the cylinder head and cylinder head cover each have recesses formed therein, and the recesses correspond to define the coolant jacket.

12. A watercraft as in claim 11 additionally comprising an exhaust system, the cooling system further including an exhaust coolant jacket that extends along a portion of the exhaust system and a delivery conduit that extends between the exhaust coolant jacket and the coolant passage.

13. A watercraft as in claim 10, wherein the cooling system includes a plurality of cooling jackets formed between the cylinder head and the cylinder head cover.

14. A multiple cylinder engine for a small watercraft comprising a plurality of combustion chambers, a plurality of coolant jackets, each coolant jacket juxtaposing at least a portion of one of the combustion chambers, and a coolant passage communicating with each of the coolant jackets, each coolant jacket communicating with the coolant passage independent of the other, the coolant passage arranged on the engine so as to be generally higher than each of the coolant jackets.

15. An engine as in claim 14, wherein each of the combustion chambers is formed at an end of a corresponding cylinder of the engine, and the cylinders are inclined.

16. An engine as in claim 14 additionally comprising a cylinder head and a cylinder head cover, and the coolant passage is formed at least in part by at least either the cylinder head or the cylinder head cover.

17. An engine as in claim 16, wherein the cylinder head and the cylinder head cover together define the coolant passage.

18. An engine as in claim 16, wherein the cylinder head and the cylinder head cover together define at least one of the coolant jackets.

19. An engine as in claim 14 additionally comprising an output shaft that rotates about an axis which is generally parallel to the coolant passage.

20. An engine as in claim 3, wherein the coolant passage directs coolant flowing therethrough in a direction generally parallel to the cylinder plane.

21. A multiple cylinder engine for a small watercraft comprising a cylinder block assembly defining a plurality of cylinders, a cylinder head coupled to the cylinder block assembly to form at least in part a plurality of combustion chambers within the engine, and a cylinder head cover attached to the cylinder head opposite of the cylinders, the cylinder head and the cylinder head cover together defining a plurality of coolant jackets and at least part of a coolant passage, each coolant jacket communicating with the coolant passage and surrounding at least a portion of a corresponding one of the combustion chambers, and the cylinders of the engine being inclined, with each cylinder lying about a corresponding incline axis, and the coolant passage is arranged above the incline axes.

22. An engine as in claim 21, wherein the cylinder head has a plurality of concave chambers and the cylinder head cover includes a plurality of concave chambers that correspond and cooperate with the chambers in the cylinder head to form the coolant jackets when the cylinder head cover and cylinder head are attached together.

23. An engine as in claim 22, wherein the coolant passage is formed when the cylinder head cover and cylinder head are attached together.

24. A multiple cylinder engine for a small watercraft comprising a cylinder block assembly defining a plurality of cylinders, a cylinder head coupled to the cylinder block assembly to form at least in part a plurality of combustion chambers within the engine, and a cylinder head cover attached to the cylinder head opposite of the cylinders, the cylinder head having a plurality of concave chambers, the cylinder head cover having a plurality of concave chambers that correspond and cooperate with the chambers in the cylinder head to form a plurality of coolant jackets when the cylinder head cover and cylinder head are attached together, and each coolant jacket surrounds at least a portion of a corresponding one of the combustion chambers.

25. An engine as in claim 24, wherein the cylinder head and the cylinder head cover cooperate to form a coolant passage, and the coolant passage communicates with each of the coolant jackets.

26. A multiple cylinder engine for a small watercraft comprising a cylinder block assembly defining a plurality of cylinders, a cylinder head coupled to the cylinder block assembly to form at least in part a plurality of combustion chambers within the engine, and a cylinder head cover attached to the cylinder head opposite of the cylinders, the cylinder head and the cylinder head cover together defining a plurality of coolant jackets, the cylinder head having a plurality of concave chambers that are closed to form the coolant jackets when the cylinder head cover is attached to the cylinder head, the cylinder head additionally including a plurality of reinforcing ribs arranged within the concave chambers, and each coolant jacket surrounds at least a portion of a corresponding one of the combustion chambers.

27. An engine as in claim 26, wherein the cylinder head cover includes a plurality of concave chambers that correspond and cooperate with the cylinder head concave chambers to define the coolant jackets.

28. An engine as in claim 26 additionally comprising a coolant passage formed by the cylinder head and the cylinder head cover, the coolant passage communicating with each of the coolant jackets.

29. A watercraft comprising an engine including at least one combustion chamber and an output shaft, a propulsion device driven by the output shaft, an exhaust system, and a cooling system for the engine, the cooling system including at least one coolant jacket that at least partially juxtaposes the at least one combustion chamber, a coolant passage communicating with the coolant jacket, the coolant jacket and the coolant passage being defined at least in part by a cylinder head and a cylinder head cover of the engine that are formed separately from each other, an exhaust coolant jacket that extends along a portion of the exhaust system, and a delivery conduit that extends between the exhaust coolant jacket and the coolant passage.

30. A watercraft as in claim 29, having at least two coolant jackets, and each coolant jacket has an outlet that communicates with the coolant passage, the outlets being independent of and spaced from each other.

31. A multiple cylinder engine for a small watercraft comprising a plurality of combustion chambers, each combustion chamber being formed at an end of a corresponding cylinder of the engine, the cylinders being inclined, a plurality of coolant jackets, each coolant jacket juxtaposing at least a portion of one of the combustion chambers, and a coolant passage communicating with each of the coolant jackets, the coolant passage arranged on the engine so as to be generally higher than each of the coolant jackets.

32. An engine as in claim 31, wherein at least two of the cylinders are adjacent to each other and have longitudinal center lines that lie in a first plane, and the coolant jackets are adapted so that coolant flowing therethrough flows generally in a direction substantially transverse to the first plane.

33. An engine as in claim 31, wherein the coolant passage is adapted to direct coolant flowing therethrough in a direction substantially parallel to the first plane.

34. A multiple cylinder engine for a small watercraft comprising a cylinder head, a cylinder head cover, a plurality of combustion chambers, a plurality of coolant jackets, each coolant jacket juxtaposing at least a portion of one of the combustion chambers, and a coolant passage communicating with each of the coolant jackets, the coolant passage arranged on the engine so as to be generally higher than each of the coolant jackets, and the cylinder head and the cylinder hear cover together define the coolant passage.

35. An engine as in claim 34, wherein the cylinder head and the cylinder head cover together define at least one of the coolant jackets.

36. A multiple cylinder engine for a small watercraft comprising a plurality of combustion chambers, a plurality of coolant jackets, each coolant jacket juxtaposing at least a portion of one of the combustion chambers and having an outlet, the outlets being independent of and spaced from each other, and a coolant passage communicating with each of the coolant jacket outlets, the coolant passage arranged on the engine so as to be generally higher than each of the coolant jacket outlets.

37. An engine as in claim 36, wherein each of the combustion chambers is formed at an end of a corresponding cylinder of the engine, and the cylinders are inclined.

38. An engine as in claim 36, wherein each outlet is positioned in an upper portion of the corresponding coolant jacket.

39. An engine as in claim 36, wherein each outlet has a smaller cross sectional flow area than its associated coolant jacket.

40. An engine as in claim 39, wherein the output shaft is generally horizontal.

* * * * *

UNITED STATES PATENT AND TRADEMARK OFFICE

CERTIFICATE OF CORRECTION

PATENT NO. : 6,071,158
DATED : June 6, 2000
INVENTOR(S) : Mashiko

It is certified that error appears in the above-identified patent and that said Letters Patent is hereby corrected as shown below:

Column 12,
Line 19, please change “hear cover” to -- head cover --.

Signed and Sealed this

Twenty-seventh Day of August, 2002

*Attest:*

*Attesting Officer*

JAMES E. ROGAN
*Director of the United States Patent and Trademark Office*